US010698354B2

(12) United States Patent
Ishizuka et al.

(10) Patent No.: US 10,698,354 B2
(45) Date of Patent: Jun. 30, 2020

(54) IMAGE FORMING APPARATUS, IMAGE FORMING METHOD, AND NON-TRANSITORY COMPUTER-READABLE STORAGE MEDIUM

(71) Applicants: Natsuko Ishizuka, Kanagawa (JP); Junichi Shimoda, Tokyo (JP); Kazushi Takei, Kanagawa (JP); Takuya Kemmochi, Kanagawa (JP); Naohiro Funada, Kanagawa (JP)

(72) Inventors: Natsuko Ishizuka, Kanagawa (JP); Junichi Shimoda, Tokyo (JP); Kazushi Takei, Kanagawa (JP); Takuya Kemmochi, Kanagawa (JP); Naohiro Funada, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/382,757

(22) Filed: Apr. 12, 2019

(65) Prior Publication Data

US 2019/0369538 A1 Dec. 5, 2019

(30) Foreign Application Priority Data

May 30, 2018 (JP) ..... 2018-103584

(51) Int. Cl.
*G03G 15/00* (2006.01)
*G03G 15/01* (2006.01)

(52) U.S. Cl.
CPC ..... *G03G 15/5041* (2013.01); *G03G 15/0121* (2013.01)

(58) Field of Classification Search
CPC ..... G03G 15/5041; G03G 15/0121
See application file for complete search history.

(56) References Cited

U.S. PATENT DOCUMENTS

2008/0181634 A1* 7/2008 Kinoshita ..... G03G 15/011 399/39
2010/0080603 A1* 4/2010 Takahashi ..... G03G 15/50 399/72

(Continued)

FOREIGN PATENT DOCUMENTS

| | | |
|---|---|---|
| JP | 2007-025315 | 2/2007 |
| JP | 2011-059377 | 3/2011 |
| JP | 2017-103497 | 6/2017 |

*Primary Examiner* — Susan S Lee
(74) *Attorney, Agent, or Firm* — Harness, Dickey and Pierce, P.L.C.

(57) ABSTRACT

An image forming apparatus includes an image bearer, a driver, an image forming device, a sensor, and circuitry. The driver drives and rotates the image bearer. The image forming device forms a toner image on the image bearer driven and rotated by the driver. The sensor emits light to the image bearer and receives reflected light. The circuitry controls the driver and the image forming device to form a first toner image with a first color and a second toner image with a second color different from the first color. The circuitry controls the sensor to detect specularly reflected light and diffusely reflected light from the first toner image and the second toner image. The circuitry calculates an amount of misalignment of the first toner image and the second toner image based on a value of the specularly reflected light and a value of the diffusely reflected light.

12 Claims, 10 Drawing Sheets

(56) References Cited

U.S. PATENT DOCUMENTS

| | | | | |
|---|---|---|---|---|
| 2012/0288283 | A1* | 11/2012 | Meyer | G08C 17/02 398/115 |
| 2014/0178109 | A1* | 6/2014 | Tanaka | G03G 15/5041 399/301 |
| 2017/0023888 | A1* | 1/2017 | Shibasaki | G03G 15/1615 |

* cited by examiner

IMAGE FORMING APPARATUS, IMAGE FORMING METHOD, AND NON-TRANSITORY COMPUTER-READABLE STORAGE MEDIUM

CROSS-REFERENCE TO RELATED APPLICATIONS

This patent application is based on and claims priority pursuant to 35 U.S.C. § 119(a) to Japanese Patent Application No. 2018-103584, filed on May 30, 2018, in the Japan Patent Office, the entire disclosure of which is hereby incorporated by reference herein.

BACKGROUND

Technical Field

Embodiments of the present disclosure relate to an image forming apparatus, an image forming method, and a non-transitory computer-readable storage medium.

Related Art

Various types of electrophotographic image forming apparatuses are known, including copiers, printers, facsimile machines, and multifunction machines having two or more of copying, printing, scanning, facsimile, plotter, and other capabilities. Such image forming apparatuses usually form an image on a recording medium according to image data. Specifically, in such image forming apparatuses, for example, a charger uniformly charges a surface of a photoconductor as an image bearer. An optical writer irradiates the surface of the photoconductor thus charged with a light beam to form an electrostatic latent image on the surface of the photoconductor according to the image data. A developing device supplies toner to the electrostatic latent image thus formed to render the electrostatic latent image visible as a toner image. The toner image is then transferred onto a recording medium either directly, or indirectly via an intermediate transfer belt. Finally, a fixing device applies heat and pressure to the recording medium bearing the toner image to fix the toner image onto the recording medium. Thus, an image is formed on the recording medium.

Such image forming apparatuses superimpose toner images in different colors (generally, four colors of yellow, magenta, cyan and black) one atop another to form a full-color toner image. One approach to improper alignment of different colors of toner images involves color registration, which includes forming, on an image bearer (e.g., transfer belt), toner patterns for adjustment in different colors, detecting improper alignment of the toner images with an optical sensor, and correcting the improper alignment of the toner images.

SUMMARY

In one embodiment of the present disclosure, a novel image forming apparatus includes an image bearer, a driver, an image forming device, a sensor, and circuitry. The driver is configured to drive and rotate the image bearer. The image forming device is configured to form a toner image on the image bearer driven and rotated by the driver. The sensor is configured to emit light to the image bearer and receive reflected light. The circuitry is configured to: control the driver and the image forming device to form a first toner image with a first color and a second toner image with a second color different from the first color; control the sensor to detect specularly reflected light and diffusely reflected light from the first toner image and the second toner image; and calculate an amount of misalignment of the first toner image and the second toner image based on a value of the specularly reflected light and a value of the diffusely reflected light.

Also described are novel image processing method and non-transitory, computer-readable storage medium storing computer-readable program code that causes a computer to perform the image forming method.

BRIEF DESCRIPTION OF THE DRAWINGS

A more complete appreciation of the embodiments and many of the attendant advantages and features thereof can be readily obtained and understood from the following detailed description with reference to the accompanying drawings, wherein.

The accompanying drawings are intended to depict embodiments of the present disclosure and should not be interpreted to limit the scope thereof. Also, identical or similar reference numerals designate identical or similar components throughout the several views.

DETAILED DESCRIPTION

Figure 1:
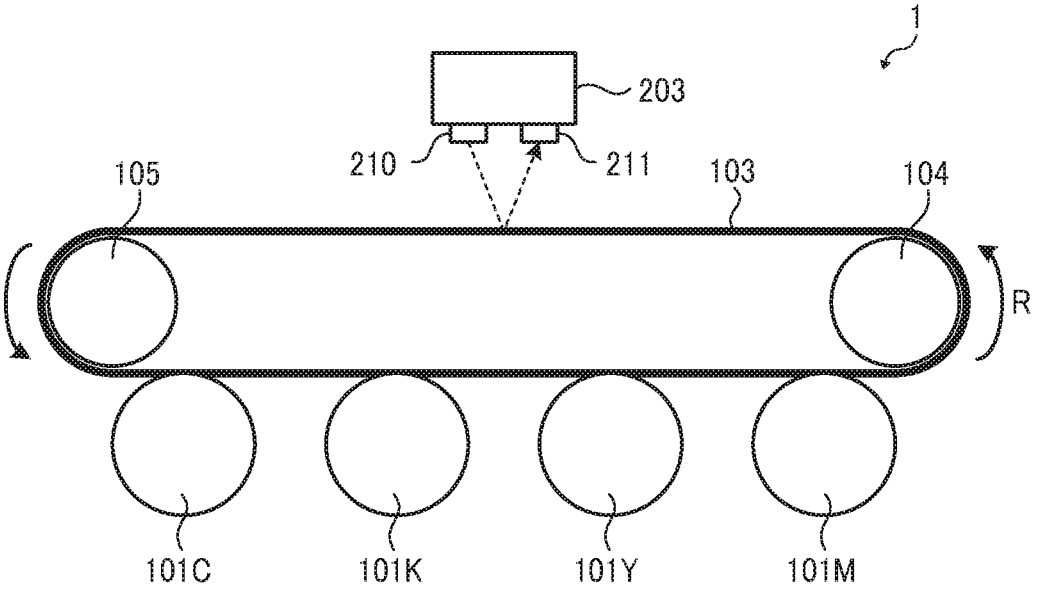
FIG. 1 is a partial diagram of an image forming apparatus according to an embodiment of the present disclosure.

In describing embodiments illustrated in the drawings, specific terminology is employed for the sake of clarity. However, the disclosure of the present specification is not intended to be limited to the specific terminology so selected and it is to be understood that each specific element includes all technical equivalents that have a similar function, operate in a similar manner, and achieve a similar result.

Although the embodiments are described with technical limitations with reference to the attached drawings, such description is not intended to limit the scope of the disclosure and not all of the components or elements described in the embodiments of the present disclosure are indispensable to the present disclosure.

In a later-described comparative example, embodiment, and exemplary variation, for the sake of simplicity like reference numerals are given to identical or corresponding constituent elements such as parts and materials having the same functions, and redundant descriptions thereof are omitted unless otherwise required.

As used herein, the singular forms "a", "an", and "the" are intended to include the plural forms as well, unless the context clearly indicates otherwise.

It is to be noted that, in the following description, suffixes C, K, Y, and M denote colors cyan, black, yellow, and magenta, respectively. To simplify the description, these suffixes are omitted unless necessary.

Referring to the drawings, wherein like reference numerals designate identical or corresponding parts throughout the several views, embodiments of the present disclosure are described below.

Initially with reference to FIG. 1, a description is given of an outline of image formation performed by an image forming apparatus according to an embodiment of the present disclosure.

FIG. 1 is a partial diagram of an image forming apparatus 1 according to a first embodiment of the present disclosure.

In the present embodiment, the image forming apparatus 1 is a color copier. FIG. 1 particularly illustrates relative positions of image forming devices 101C, 101K, 101Y, and 101M, a transfer belt 103, and a sensor 203. The image forming apparatus 1 illustrated in FIG. 1 has a tandem structure to form an image on a recording medium according to an electrophotographic image forming process.

Specifically, an image processing portion of the image forming apparatus 1 includes the four image forming devices 101C, 101K, 101Y, and 101M that form toner images in different colors, namely, cyan, black, yellow, and magenta, respectively. The four image forming devices 101C, 101K, 101Y, and 101M are arranged in a line along the transfer belt 103, thereby constructing the tandem structure. The transfer belt 103 serves as an image bearer that bears toner images and conveys a recording medium as a transfer medium. The transfer belt 103 is entrained around a driving roller 105 and a driven roller 104 that rotates in association with the driving roller 105. Rotation of the driving roller 105 drives and rotates the transfer belt 103 in a direction R illustrated in FIG. 1. Near the transfer belt 103 is an input tray that stores recording media. An uppermost recording medium of the recording media is fed from the input tray toward the transfer belt 103 upon image formation.

Each of the image forming devices 101C, 101K, 101Y, and 101M includes a photoconductive drum serving as a photoconductor, a charger, a developing device, a photoconductor cleaner, and a transfer device to form a toner image according to a general electrophotographic process. The charger, the developing device, the photoconductor cleaner, and the transfer device are arranged around the photoconductive drum.

In the image forming device 101C, for example, the charger uniformly charges a surface of the photoconductive drum. Then, an exposure device irradiates the surface of the photoconductive drum with laser light corresponding to a cyan image, thereby forming an electrostatic latent image on the surface of the photoconductive drum. The developing device develops the electrostatic latent image thus formed, rendering the electrostatic latent image visible as a toner image. Thus, a toner image is formed on the surface of the photoconductive drum. The transfer device transfers the toner image onto the transfer belt 103 at a transfer position where the photoconductive drum contacts the transfer belt 103. As a result, the image forming device 101C forms a single-color toner image (in this case, a cyan toner image) on the transfer belt 103. The photoconductor cleaner cleans the surface of the photoconductive drum after the toner image is transferred onto the transfer belt 103. Specifically, the photoconductor cleaner removes residual toner from the surface of the photoconductive drum. The residual toner is herein toner that has failed to be transferred onto the transfer belt 103 and therefore remaining on the surface of the photoconductive drum. After the cleaning, the surface of the photoconductive drum is initialized to be ready for next image formation.

As the transfer belt 103 rotates, the single (i.e., cyan) toner image transferred from the image forming device 101C onto the transfer belt 103 is conveyed to a position where the cyan toner image faces the image forming device 101K, which is disposed adjacent to the image forming device 101C. Similarly to the cyan image formation described above, the image forming device 101K forms a black toner image and transfers the black toner image from the photoconductive drum onto the transfer belt 103, superimposing the black toner image on the cyan toner image. As the transfer belt 103 rotates, the superimposed toner images are conveyed to a position where the superimposed toner images face the image forming device 101Y, which is disposed adjacent to the image forming device 101K. The image forming device 101Y forms a yellow toner image and transfers the yellow toner image from the photoconductive drum onto the transfer belt 103, superimposing the yellow toner image on the cyan and black toner images. Similarly, as the transfer belt 103 rotates, the superimposed toner images are conveyed to a position where the superimposed toner images face the image forming device 101M, which is disposed adjacent to the image forming device 101Y. The image forming device 101M forms a magenta toner image and transfers the magenta toner image from the photoconductive drum onto the transfer belt 103, superimposing the magenta toner image on the cyan, black, and yellow toner images. As a result, a composite color toner image is formed on the transfer belt 103. Thereafter, as the transfer belt 103 rotates, the color toner image is conveyed to a position where the color toner image is transferred from the transfer belt 103 onto a recording medium fed from the input tray. The recording medium bearing the color toner image then reaches a fixing device, which fixes the color toner image onto the recording medium under heat and pressure.

For color registration, for example, the image forming apparatus 1 forms a color registration pattern 110 (illustrated in, e.g., FIG. 4) on the transfer belt 103 serving as an image bearer. The color registration pattern 110 is a toner pattern image including, e.g., a first toner image of a first color and a second toner image of a second color different from the first color.

The image forming apparatus 1 further includes the sensor 203 near the transfer belt 103. The sensor 203 emits light onto the transfer belt 103 and receives reflected light. The sensor 203 incorporates a light emitting part 210 and a light receiving part 211 as integral parts thereof. The light emitting part 210 is, e.g., a light emitting diode (LED). The light receiving part 211 is, e.g., a photosensor.

The sensor 203 detects the color registration pattern 110 formed as a toner pattern image on the transfer belt 103. For example, the sensor 203 detects specularly reflected light and diffusely reflected light from the first toner image and the second toner image when the transfer belt 103 serving as an image bearer moves or rotates while bearing the first toner image and the second toner image.

In light of the tandem system or structure employed by the image forming apparatus 1, the alignment of colors (i.e., color registration) has some significance. Examples of misalignment of colors or mismatch of CKYM registration include improper registration in a main scanning direction (i.e., direction parallel to an axis of the photoconductive drum), improper registration in a sub-scanning direction (i.e., direction perpendicular to the axis of the photoconductive drum), difference in main-scanning magnification, and skew misalignment. In the present embodiment, the image forming apparatus 1 performs color registration to correct misalignment of different color images with the color registration pattern 110 (illustrated in, e.g., FIG. 4) as a toner pattern image, prior to the actual formation of a color image on a recording medium.

Figure 2:
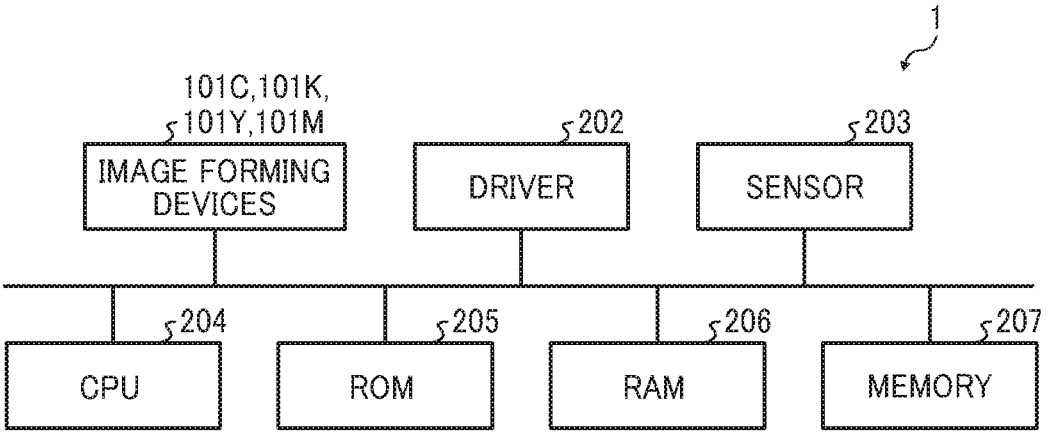
FIG. 2 is a block diagram illustrating a main configuration of the image forming apparatus.

Referring now to FIG. 2, a description is given of a configuration of the image forming apparatus 1.

FIG. 2 is a block diagram illustrating a main configuration of the image forming apparatus 1.

In addition to the image forming devices 101C, 101K, 101Y, and 101M, and the sensor 203 described above, the image forming apparatus 1 includes a driver 202, a central processing unit (CPU) 204, a read only memory (ROM) 205, a random access memory (RAM) 206, and a memory 207.

The CPU 204 serves as a controller to control the entire image forming apparatus 1. The ROM 205 stores a program that the CPU 204 executes. The CPU 204 reads the program from the ROM 205 to execute the program. The RAM 206 is used as a working memory upon the controlling by the CPU 204. Examples of the memory 207 include a hard disk drive (HDD), a ROM, and a RAM.

The driver 202 drives the driving roller 105, thereby driving and rotating the transfer belt 103. The image forming devices 101C, 101K, 101Y, and 101M respectively form cyan, black, yellow, and magenta toner images, in sequence, in the sub-scanning direction. Note that the sub-scanning direction is the direction R in which the transfer belt 103 rotates. In the present example, the cyan toner image serves as the first toner image of the first color; whereas the black toner image serves as the second toner image of the second color different from the first color.

Figure 3:
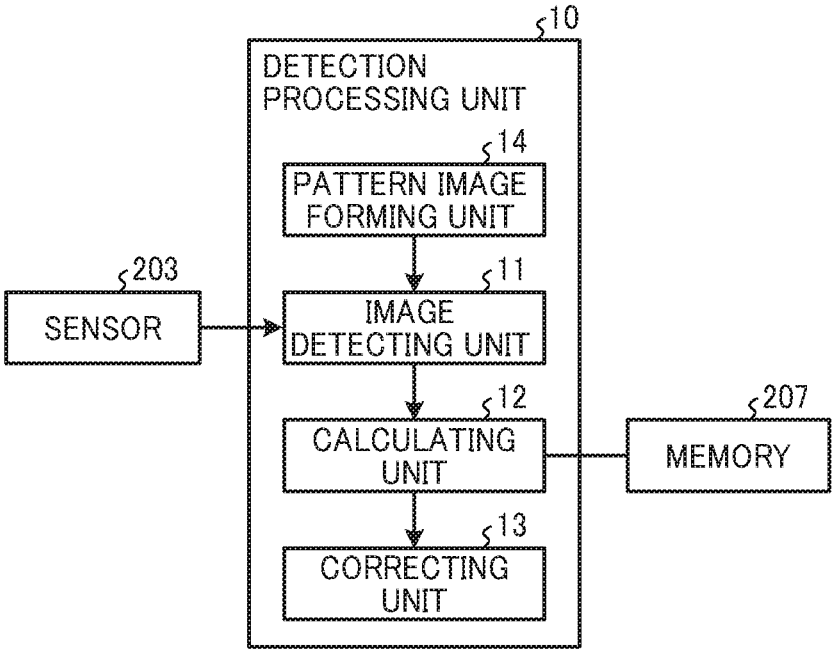
FIG. 3 is a block diagram illustrating a functional configuration of a detection processing unit implemented by a central processing unit (CPU) in the image forming apparatus.

Referring now to FIG. 3, a description is given of a function implemented by the CPU 204.

FIG. 3 is a block diagram illustrating a functional configuration of a detection processing unit 10 implemented by the CPU 204.

The CPU 204 executes a program stored in the ROM 205, for example, thereby implementing the detection processing unit 10 illustrated in FIG. 3. The detection processing unit 10 includes functions of an image detecting unit 11, a calculating unit 12, a correcting unit 13, and a pattern image forming unit 14 serving as image detecting means, calculating means, correcting means, and pattern image forming means, respectively.

The pattern image forming unit 14 controls the driver 202 and the image forming devices 101C, 101K, 101Y, and 101M to form, as the color registration pattern 110, the first toner image with the first color and the second toner image with the second color different from the first color, for example.

The image detecting unit 11 performs output processing on an analog output from the light receiving part 211. The analog output corresponds to the reflected light from the color registration pattern 110.

The calculating unit 12 calculates an amount of misalignment of the first toner image and the second toner image. Specifically, when a difference (or difference value) between a peak value of the diffusely reflected light and a median value of the specularly reflected light exceeds a given threshold while the driver 202 rotates the transfer belt 103 bearing the first toner image and the second toner image, the calculating unit 12 reflects the difference in calculation of the amount of misalignment of the first toner image and the second toner image.

Based on the amount of misalignment calculated by the calculating unit 12, the correcting unit 13 performs color registration to correct the misalignment of the first toner image and the second toner image.

Note that a part or all of the functions of the detection processing unit 10 may be configured by hardware.

Figure 4:
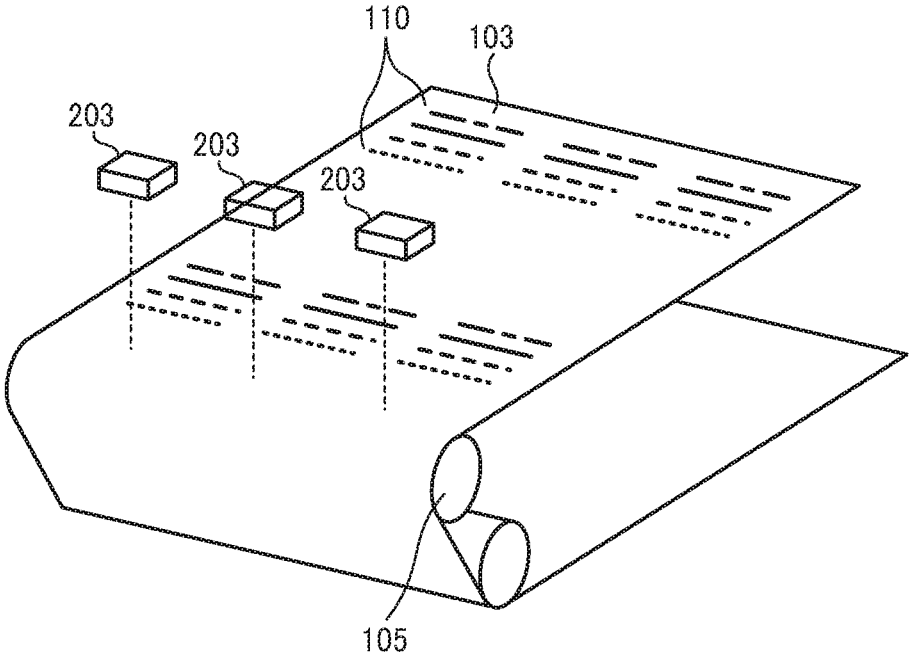
FIG. 4 is a perspective view of a transfer belt bearing patterns for color registration.

Referring now to FIG. 4, a description is given of formation and detection of the color registration pattern 110 on the transfer belt 103.

FIG. 4 is a perspective view of the transfer belt 103 bearing the color registration pattern 110.

In the image forming apparatus 1, the image forming devices 101C, 101K, 101Y, and 101M form patterns 110C, 110K, 110Y, and 110M, respectively, on the transfer belt 103 for color registration. The patterns 110C, 110K, 110Y, and 110M construct the color registration pattern 110. The sensor 203 detects the color registration pattern 110.

In the example of FIG. 4, three sensors 203 are disposed in the main scanning direction above the transfer belt 103. A plurality of color registration patterns 110 is formed on the transfer belt 103, corresponding to the position of the three sensors 203. In other words, the three sensors 203 detect the respective color registration patterns 110. In the example illustrated in FIG. 4, each of the three sensors 203 detects the color registration patterns 110 that sequentially pass the sensor 203 as the transfer belt 103 rotates in the direction R while bearing the color registration patterns 110. In response to the detection of the color registration pattern 110, the calculating unit 12 executes processing to calculate various color misalignment or misregistration amounts from the detection result. The calculating unit 12 then calculates a correction amount for each misalignment or misregistration component from the color misalignment or misregistration amounts calculated. Examples of the color misalignment or misregistration amounts include an amount of difference in main-scanning magnification, an amount of improper registration in the main scanning direction, an amount of improper registration in the sub-scanning direction, an amount of skew misalignment, and an amount of distortion.

Although FIG. 4 illustrates the three sensors 203, the number of the sensors 203 is not limited to three. That is, one or more sensors 203 may be disposed.

In the present embodiment, the calculating unit 12 determines whether a mounting angle (or tilt angle) of the sensor 203 is appropriate to calculate the correction amount.

Figure 5A:
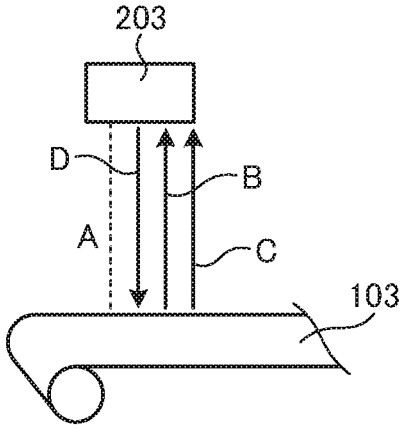
FIG. 5A is a view of a sensor and the transfer belt, illustrating the sensor being disposed right opposite to the transfer belt.
Figure 5B:
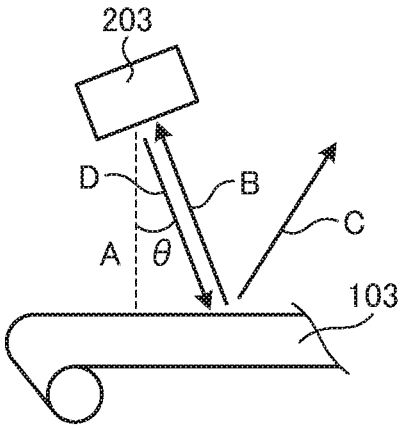
FIG. 5B is another view of the sensor and the transfer belt, illustrating the sensor being tilted.

Referring now to FIGS. 5A and 5B, a description is given of the tilt angle according to the present embodiment.

FIG. 5A is a view of the sensor 203 and the transfer belt 103, illustrating the sensor 203 being disposed right opposite to the transfer belt 103. FIG. 5B is another view of the sensor 203 and the transfer belt 103, illustrating the sensor 203 being tilted.

As illustrated in FIG. 5B, the tilt angle is defined as an angle deviation in a moving direction of the transfer belt 103. In other words, as illustrated in FIG. 5B, the tilt angle is an angle θ formed by a shortest distance A between the sensor 203 and the transfer belt 103 and specularly reflected light B when the sensor 203 is tilted with respect to the transfer belt 103. FIG. 5A illustrates a case in which the sensor 203 is disposed right opposite to the transfer belt 103. In this case, a relation of incident light D=specularly reflected light B=diffusely reflected light C is satisfied. By contrast, FIG. 5B illustrates a case in which the mounting angle of the sensor 203 is deviated. In this case, a relation of incident light D=specularly reflected light B is satisfied; whereas a relation of specularly reflected light B=diffusely reflected light C is unsatisfied.

Referring now to FIGS. 6A through 7B, a description is given of examples of color registration performed by the correcting unit 13.

Figures 6A, 6B, 6C:
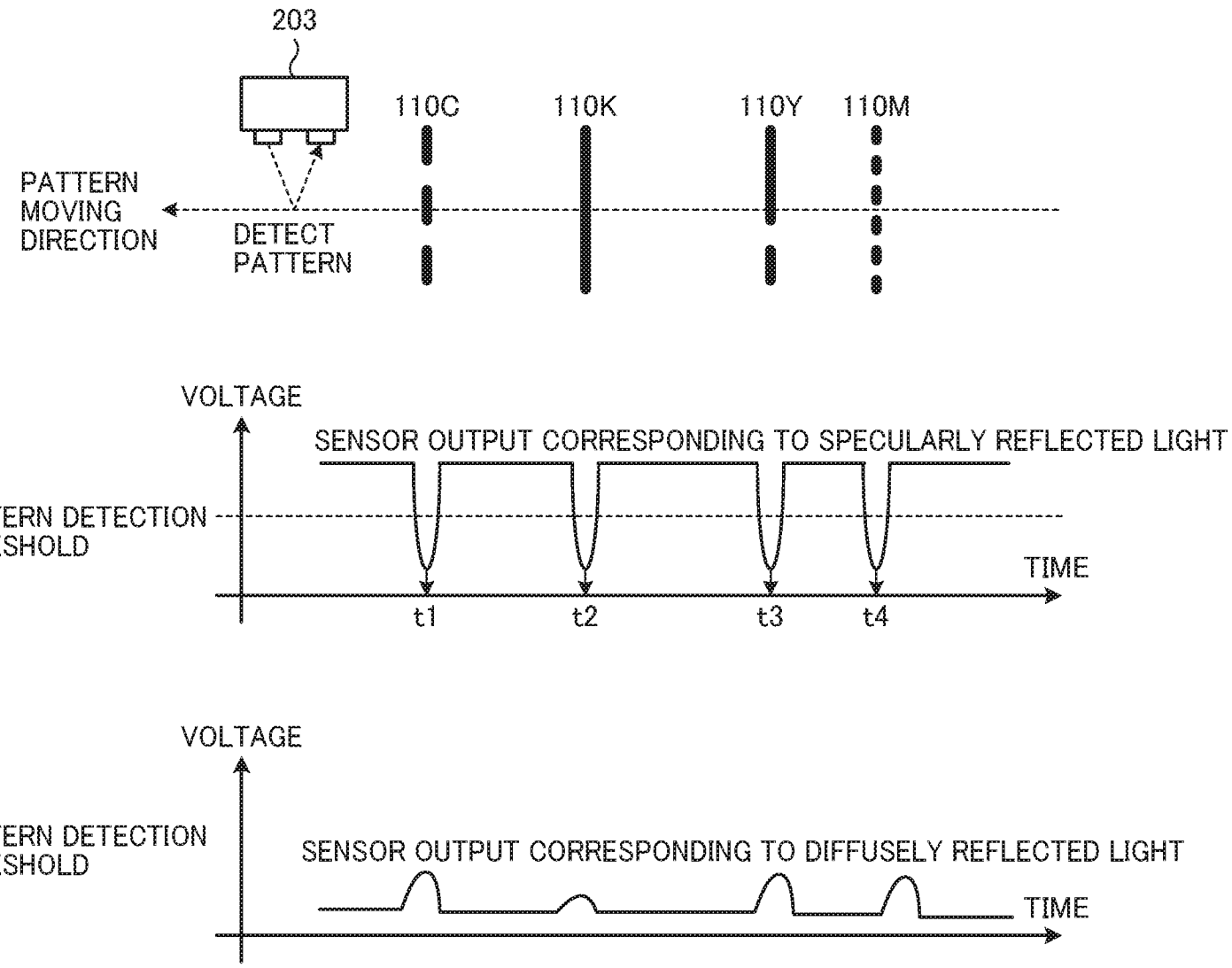
FIG. 6A is a diagram illustrating the sensor and the patterns to be detected by the sensor in a general color registration example.
FIG. 6B is a graph illustrating a waveform of specularly reflected light feedback output from the sensor.
FIG. 6C is a graph illustrating a waveform of diffusely reflected light feedback output from the sensor.

Initially with reference to FIGS. 6A through 6C, a description is given of a general color registration example.

FIG. 6A is a diagram illustrating the sensor 203 and the patterns 110C, 110K, 110Y, and 110M to be detected by the sensor 203. FIG. 6B is a graph illustrating a waveform of specularly reflected light feedback output from the sensor 203. FIG. 6C is a graph illustrating a waveform of diffusely reflected light feedback output from the sensor 203.

First, as illustrated in FIG. 6A, the pattern image forming unit 14 forms, on the transfer belt 103, the patterns 110C, 110K, 110Y, and 110M that construct the color registration pattern 110.

As the transfer belt 103 rotates, the patterns 110C, 110K, 110Y, and 110M move and pass the sensor 203 in sequence. The sensor 203 outputs specularly reflected light feedback, as a feedback waveform for misalignment correction (i.e., registration) as illustrated in FIG. 6B. The sensor 203 also outputs diffusely reflected light feedback, as a feedback waveform for misalignment correction (i.e., registration) as illustrated in FIG. 6C.

The image detecting unit 11 records a falling time and an exceeding time. At the falling time, an analog output, corresponding to the specularly reflected light, of the sensor 203 falls below a threshold for detection of the color registration pattern 110 (hereinafter referred to as a pattern detection threshold). At the exceeding time, the analog output, corresponding to the specularly reflected light, of the sensor 203 exceeds the pattern detection threshold. The image detecting unit 11 regards a median time between the falling time and the exceeding time as the time when the color registration pattern 110 passes. Specifically, in FIG. 6B, t1 represents the time when the pattern 110C passes. Similarly, t2, t3, and t4 represent the times when the patterns 110K, 110Y, and 110M pass, respectively.

Figure 7A:
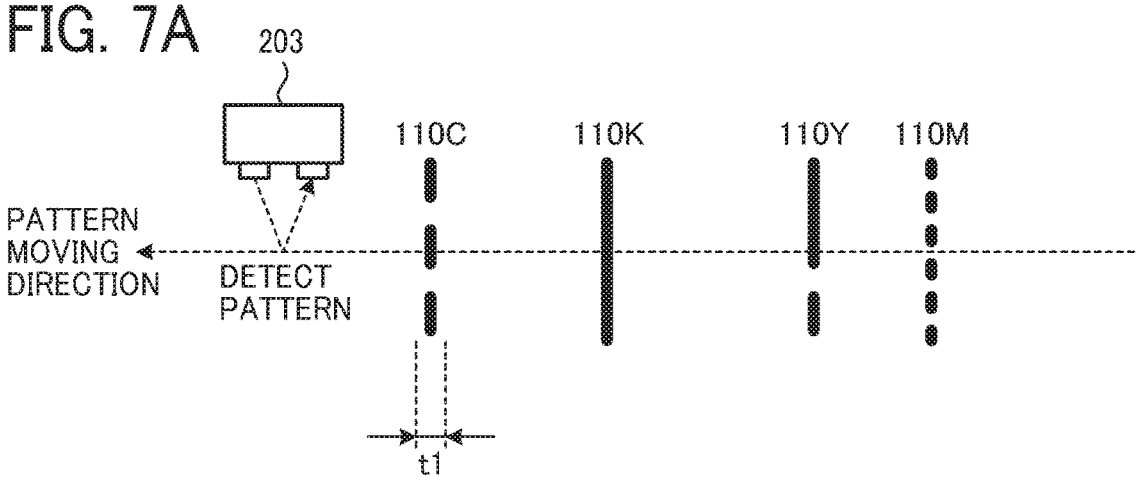
FIG. 7A is a diagram illustrating the sensor and the patterns to be detected by the sensor in an example of color registration with a median value of specularly reflected light.
Figure 7B:
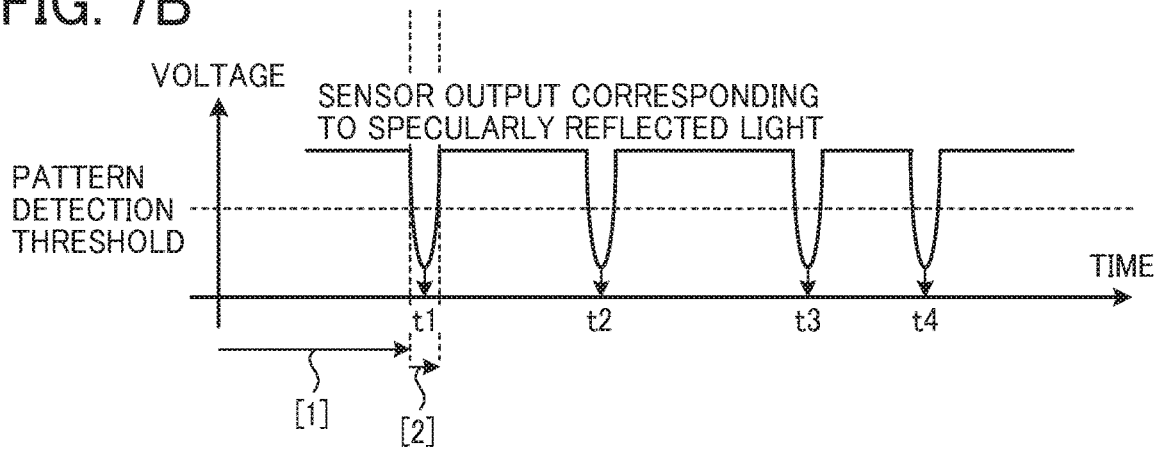
FIG. 7B is a graph illustrating a waveform of specularly reflected light feedback output from the sensor.

Referring now to FIGS. 7A and 7B, a description is given of an example of color registration with a median value of specularly reflected light.

FIG. 7A is a diagram illustrating the sensor 203 and the patterns 110C, 110K, 110Y, and 110M to be detected by the sensor 203. FIG. 7B is a graph illustrating a waveform of specularly reflected light feedback output from the sensor 203.

As illustrated in FIGS. 7A and 7B, the image detecting unit 11 monitors the output of the sensor 203. When the transfer belt 103 moves for 50 milliseconds ([1]), the waveform falls below a pattern detection threshold. When the transfer belt 103 further moves for 20 milliseconds ([2]), the waveform exceeds the pattern detection threshold. In this case, from the [1] and the [2], the time t1 is obtained by the formula t1=(70−50)/2.

From the times t1, t2, t3, and t4 when the patterns 110C, 110K, 110Y, and 110M pass, respectively, the calculating unit 12 calculates deviation from target intervals between the patterns 110C, 110K, 110Y, and 110M aimed upon formation of the patterns 110C, 110K, 110Y, and 110M.

The correcting unit 13 reflects the deviation calculated by the calculating unit 12 in the image formation timing for each color, thereby correcting the misalignment of the toner images. Note that general misalignment correction does not use the diffusely reflected light feedback. However, since the sensor 203 is an integrated sensor, the feedback from the sensor 203 is readable.

Figure 8A:
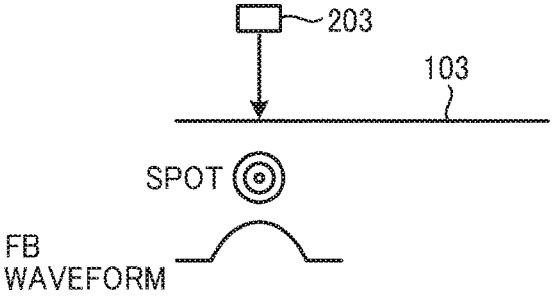
FIG. 8A is a diagram illustrating a spot and a feedback waveform in a case in which the sensor is disposed right opposite to the transfer belt.
Figure 8B:
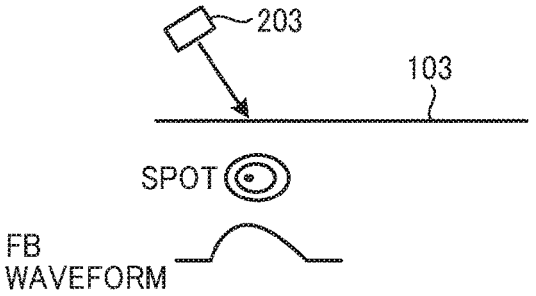
FIG. 8B is a diagram illustrating a spot and a feedback waveform in a case in which the sensor is tilted with respect to the transfer belt.

Referring now to FIGS. 8A and 8B, a description is given of color misalignment depending on the mounting angle of the sensor 203.

FIG. 8A is a diagram illustrating a spot and a feedback (FB) waveform in the case in which the sensor 203 is disposed right opposite to an image forming face of the transfer belt 103 on which images are formed. In other words, FIG. 8A illustrates a case in which the tilt angle is appropriate. FIG. 8B is a diagram illustrating a spot and an FB waveform in the case in which the sensor 203 is tilted with respect to the image forming face of the transfer belt 103. In other words, FIG. 8B illustrates a case in which the tilt angle is inappropriate.

As illustrated in FIG. 8A, when the tilt angle is correct or appropriate, the light emitted by the light emitting part 210 of the sensor 203 forms a substantially round spot, as a proper spot, on the transfer belt 103. The light receiving part 211 receives, as reflected light, the emitted light forming the substantially round spot (i.e., proper spot). As a result, the light receiving part 211 outputs the feedback that forms a symmetrical waveform.

By contrast, as illustrated in FIG. 8B, when the tilt angle is incorrect or inappropriate, the light emitted by the light emitting part 210 of the sensor 203 is tilted with respect to the image forming face of the transfer belt 103, forming an improper spot depending on the tilt angle. Specifically, the emitted light forms an elliptical spot. As a result, the light receiving part 211 outputs the feedback that forms an asymmetrical waveform, resulting in detection of the median value and the peak value being different from each other in position.

Figure 9A:
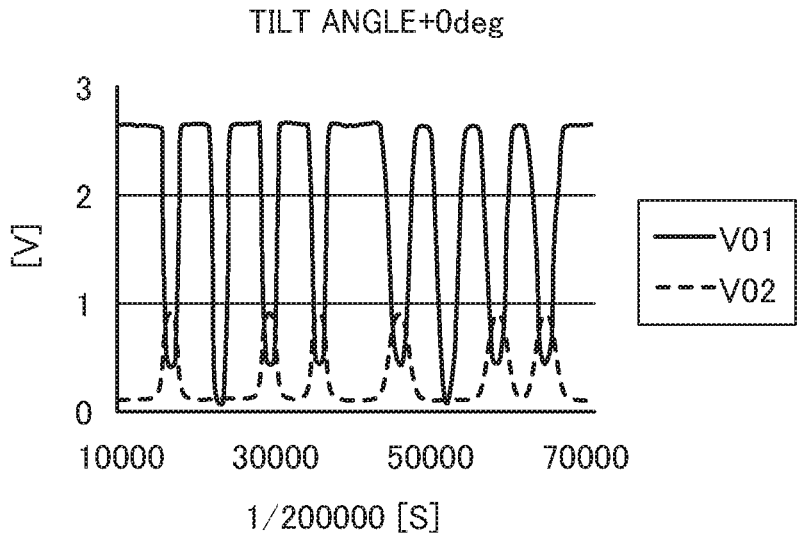
FIG. 9A is a graph illustrating an example of output waveform of the sensor in a case in which a tilt angle is appropriate.
Figure 9B:
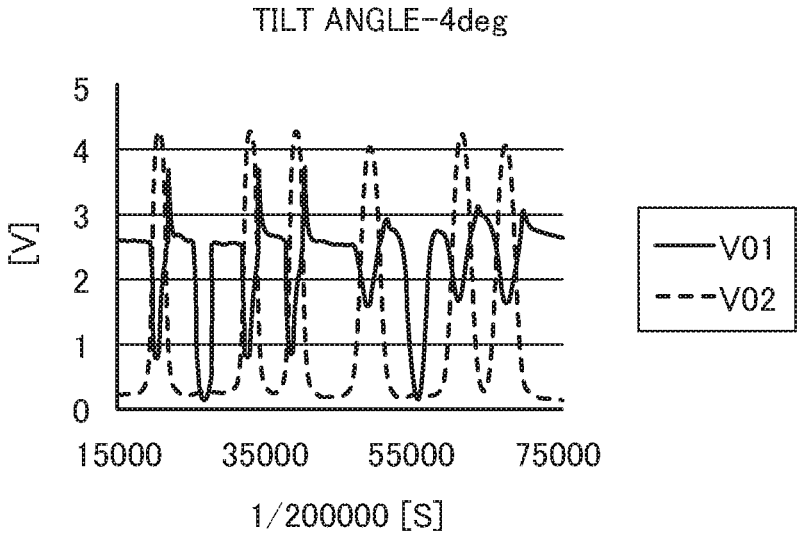
FIG. 9B is a graph illustrating an example of output waveform of the sensor in a case in which the tilt angle is inappropriate.

Referring now to FIGS. 9A and 9B, a description is given of examples of output waveform of the sensor 203 when the tilt angle is appropriate and inappropriate, respectively.

FIG. 9A is a graph illustrating an example of output waveform of the sensor 203 in a configuration in which the tilt angle is appropriate. FIG. 9B is a graph illustrating an example of output waveform of the sensor 203 in a configuration in which the tilt angle is inappropriate.

In the graphs illustrated in FIGS. 9A and 9B, the solid line indicates an output waveform V01 of the sensor 203 in response to the specularly reflected light. The broken line indicates an output waveform V02 of the sensor 203 in response to the diffusely reflected light.

In the case of FIG. 9A in which the sensor 203 faces the transfer belt 103 with an appropriate tilt angle of 0 degrees, the output waveform V01 exhibits the symmetry of dropping/rising waveforms in response to the specularly reflected light from the toner images. That is, the median value of the color registration pattern 110 is calculated as appropriate. By contrast, in the case of FIG. 9B in which the sensor 203 is tilted with respect to the transfer belt 103 with an inappropriate tilt angle of −4 degrees, the output waveform V01 exhibits distortion when dropping in response to the specularly reflected light from the toner images. That is, a position deviated from an actual median value of the color registration pattern 110 is calculated as the median value.

Figure 10:
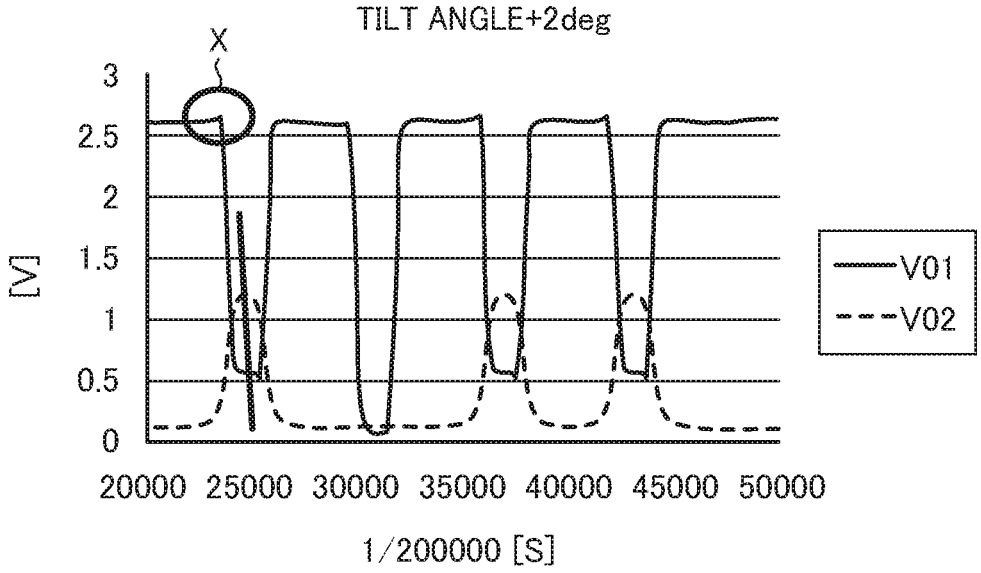
FIG. 10 is a graph illustrating a typical example of calculation of an amount of misalignment.

Referring now to FIG. 10, a description is given of a typical example of calculation of an amount of misalignment.

FIG. 10 is a graph illustrating a typical example of calculation of the amount of misalignment.

Specifically, FIG. 10 illustrates a case in which the tilt angle is +2 degrees. The solid line indicates the output waveform (i.e., output voltage) V01 of a sensor in response to the specularly reflected light. The broken line indicates the output waveform (i.e., output voltage) V02 of the sensor in response to the diffusely reflected light. Typically, an amount of overshoot, as surrounded by a circle X in FIG. 10, is acquired for registration. However, since the amount of overshoot is minute, acquisition of an amount of change is accompanied by acquisition of an output waveform of the sensor at a high sampling rate.

To address such a situation, the present embodiment uses, for the registration, the diffusely reflected light, which is acquirable simultaneously with the specularly reflected light. Accordingly, the misalignment of the color registration pattern 110 on the transfer belt 103 is reliably detected in a simple configuration without detecting the amount of overshoot.

Figure 11:
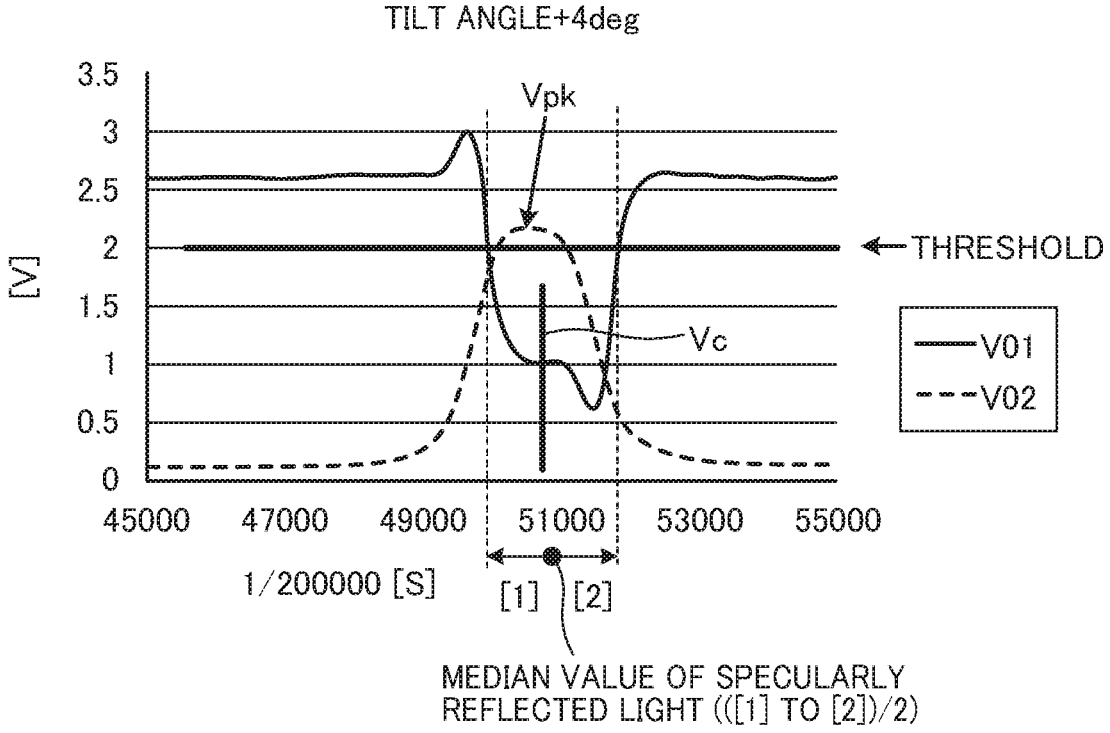
FIG. 11 is a graph illustrating an example of calculation of the amount of misalignment according to a first embodiment of the present disclosure.

Referring now to FIG. 11, a description is given of an example of calculation of an amount of misalignment according to the first embodiment of the present disclosure.

FIG. 11 is a graph illustrating an example of calculation of the amount of misalignment according to the first embodiment of the present disclosure.

Specifically, FIG. 11 illustrates a case in which the tilt angle is +4 degrees. The solid line indicates the output waveform (i.e., output voltage) V01 of the sensor 203 in response to the specularly reflected light. The broken line indicates the output waveform (i.e., output voltage) V02 of the sensor 203 in response to the diffusely reflected light.

More specifically, in FIG. 11, a position of a peak value Vpk of the diffusely reflected light (i.e., broken line) is obtained. A median value Vc of the specularly reflected light (i.e., solid line) is a value obtained by the formula ([1] to [2])/2 in FIG. 11. The peak value Vpk of the diffusely reflected light is compared with the median value Vc of the specularly reflected light. When the tilt angle is appropriate, the position of the peak value Vpk coincide with the position of the median value Vc. By contrast, when the tilt angle is inappropriate, the position of the peak value Vpk differs from the position of the median value Vc, as illustrated in FIG. 11. From the difference, the amount of misalignment caused by the tilt angle is detected. In such a way, the amount of misalignment is detected even in a slow sampling. That is, the amount of misalignment is detected with a simple configuration. In addition, the amount of misalignment thus detected is reflected in a regulation formula to accurately correct the position.

Figure 12:
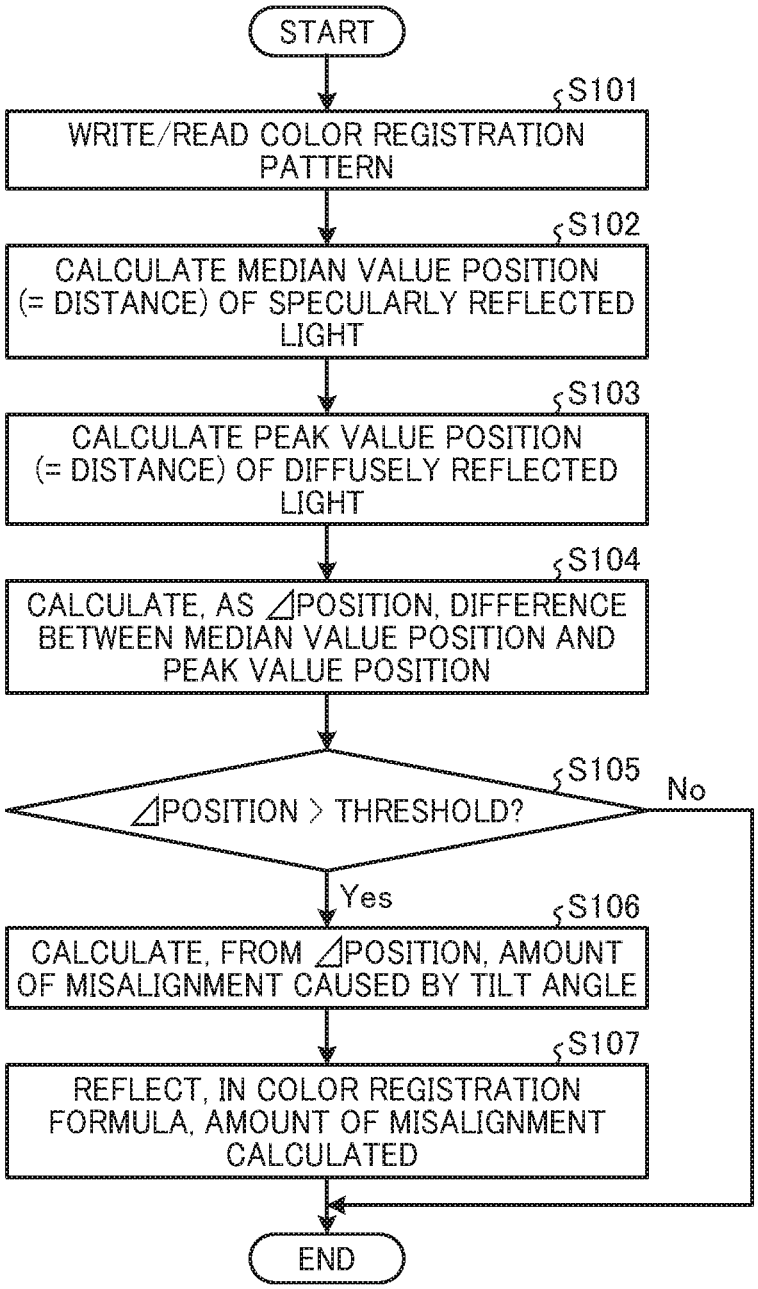
FIG. 12 is a flowchart of a registration process according to the first embodiment of the present disclosure.

Referring now to FIG. 12, a description is given of an outline of a registration process according to the first embodiment of the present disclosure.

FIG. 12 is a flowchart of the registration process according to the first embodiment of the present disclosure.

As illustrated in FIG. 12, firstly in step S101, the pattern image forming unit 14 writes the color registration pattern 110 with the image forming devices 101C, 101K, 101Y, and 101M. Then, the image detecting unit 11 reads the color registration pattern 110 with the sensor 203.

Subsequently in step S102, the calculating unit 12 calculates, as a median value position, a position (i.e., distance) of the median value Vc between falling and rising positions (i.e., distances) of the specularly reflected light. Note that the median value Vc may be, e.g., a value obtained by color registration control of correlating overlapping colors.

In step S103, the calculating unit 12 calculates, as a peak value position, a position (i.e., distance) of the peak value Vpk of the diffusely reflected light. Note that the order of steps S102 and S103 may be exchanged.

In step S104, the calculating unit 12 calculates, as Δposition, a difference between the median value position calculated in step S102 and the peak value position calculated in step S103.

In step S105, the calculating unit 12 compares the Δposition with a threshold predetermined for pattern detection (i.e., pattern detection threshold). When the Δposition exceeds the pattern detection threshold (Yes in step S105), the calculating unit 12 calculates, from the Δposition, an amount of misalignment caused by the tilt angle in step S106. Then, the process proceeds to step S107.

In step S107, the correcting unit 13 reflects, in a color registration formula, the amount of misalignment calculated in step S106.

On the other hand, when the Δposition is below the pattern detection threshold (No in step S105), the correcting unit 13 determines not to perform correction and completes the process without calculating the amount of misalignment.

Note that the process described above with reference to FIG. 12 may be executed upon the color registration control of correlating overlapping colors, for example. Alternatively, the process described above with reference to FIG. 12 may be executed once after the assembly in the manufacturing, to continue to use a value obtained in the process. Alternatively, the process described above with reference to FIG. 12 may be executed at another time, for example, upon the maintenance of the image forming devices 101C, 101K, 101Y, and 101M, to update the value.

As described above, according to the present embodiment, the inappropriateness of the mounting angle of the sensor 203 with respect to the image forming face of the transfer belt 103 is detectable from the outputs of the sensor 203 corresponding to the specularly reflected light and the diffusely reflected light received. Accordingly, even at a low sampling rate of a typical sampling cycle of about 1/300 to about 1/500, the misalignment of the color registration pattern 110 on the transfer belt 103 is reliably detectable, enhancing accurate registration of toner images.

Figure 13:
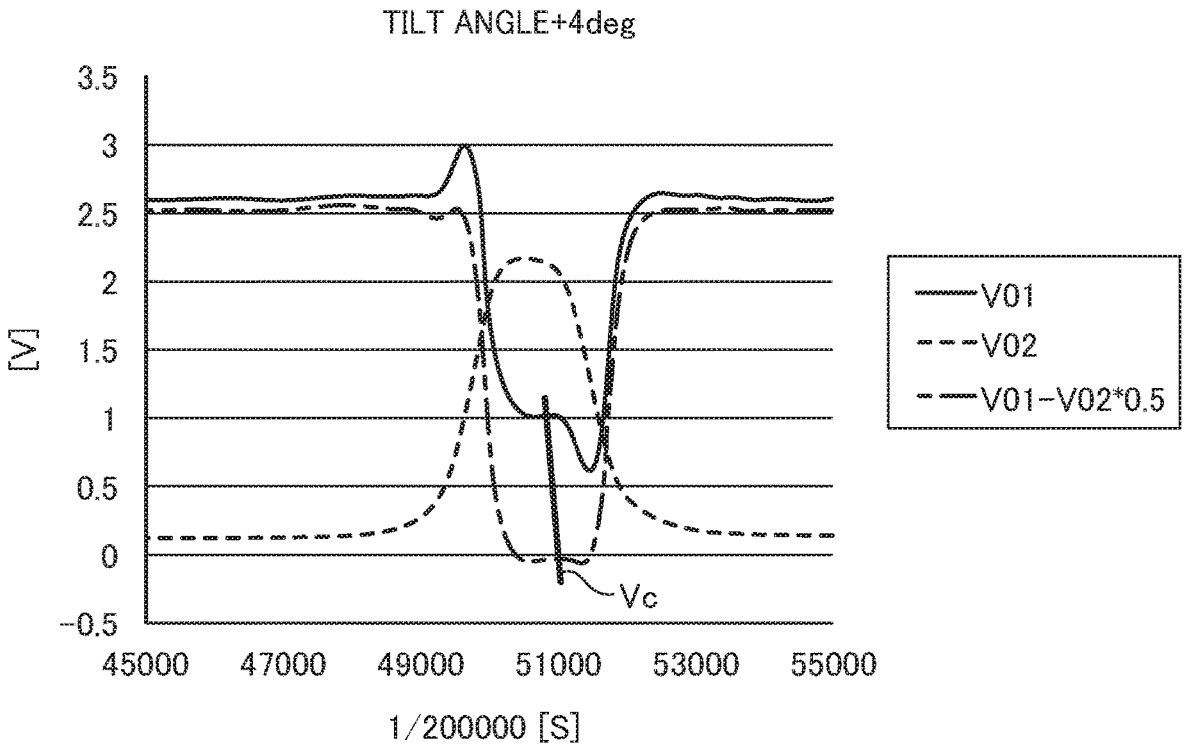
FIG. 13 is a graph illustrating an example of calculation of the amount of misalignment according to a second embodiment of the present disclosure.
Figure 14:
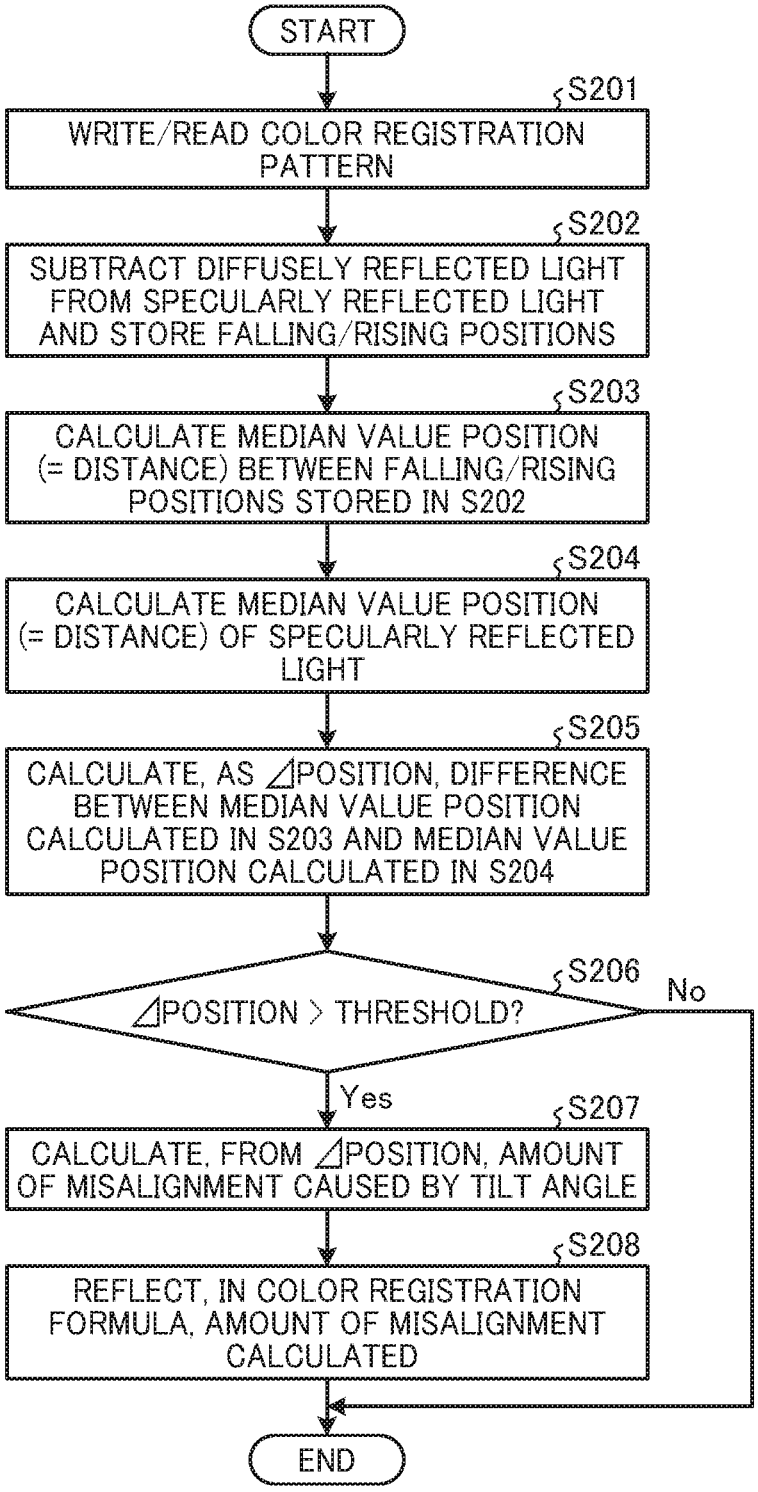
FIG. 14 is a flowchart of a registration process according to the second embodiment of the present disclosure.

Referring now to FIGS. 13 and 14, a description is given of a second embodiment of the present disclosure.

The second embodiment differs from the first embodiment in how to calculate the amount of misalignment. A redundant description of identical features in the first and second embodiments is herein omitted; whereas a description is now given of features of the second embodiment different from the features of the first embodiment.

Initially with reference to FIG. 13, a description is given of an example of calculation of the amount of misalignment according to the second embodiment of the present disclosure.

FIG. 13 is a graph illustrating an example of calculation of the amount of misalignment according to the second embodiment of the present disclosure.

In FIG. 13, the solid line indicates the output waveform (i.e., output voltage) V01 of the sensor 203 in response to the specularly reflected light. The broken line indicates the output waveform (i.e., output voltage) V02 of the sensor 203 in response to the diffusely reflected light. The long dashed short dashed line indicates a waveform (hereinafter referred to as a subtraction waveform), which is obtained by subtracting a component of the diffusely reflected light from the waveform of the specularly reflected light. In FIG. 13, when the mounting angle of the sensor 203 is appropriate, the median value of the solid line (i.e., the median value Vc of the output waveform V01) coincide, in position, with the median value of the long dashed short dashed line (i.e., the median value Vc of the subtraction waveform). By contrast, when the mounting angle of the sensor 203 is inappropriate, the positions of the median values Vc differ from each other. The amount of misalignment may be calculated by comparison of the positions of the median values Vc.

Referring now to FIG. 14, a description is given of an outline of a registration process according to the second embodiment of the present disclosure.

FIG. 14 is a flowchart of the registration process according to the second embodiment of the present disclosure.

As illustrated in FIG. 14, firstly in step S201, the pattern image forming unit 14 writes the color registration pattern 110 with the image forming devices 101C, 101K, 101Y, and 101M. Then, the image detecting unit 11 reads the color registration pattern 110 with the sensor 203.

Subsequently in step S202, the calculating unit 12 subtracts a voltage value of the diffusely reflected light from the waveform of the specularly reflected light to obtain a subtraction waveform. The calculating unit 12 calculates a falling position (i.e., distance) and a rising position (i.e., distance). From the falling position, the subtraction waveform gets lower than a threshold predetermined for pattern detection (i.e., pattern detection threshold). From the rising position, the subtraction waveform gets higher than the pattern detection threshold. Then, the calculating unit 12 stores the falling and rising positions in the memory 207.

In step S203, the calculating unit 12 calculates, as a median value position, a position (i.e., distance) of the median value Vc between the falling and rising positions calculated and stored in step S202.

In step S204, the calculating unit 12 calculates, as a median value position, a position (i.e., distance) of the median value Vc between the falling and rising positions (i.e., distances) of the specularly reflected light. Note that the median value Vc may be, e.g., a value obtained by the color registration control of correlating overlapping colors. The order of steps S203 and S204 may be exchanged.

In step S205, the calculating unit 12 calculates, as Δposition, a difference between the median value position calculated in step S203 and the median value position calculated in step S204.

In step S206, the calculating unit 12 compares the Δposition with the pattern detection threshold. When the Δposition exceeds the pattern detection threshold (Yes in step S206), the calculating unit 12 calculates, from the Δposition, an amount of misalignment caused by the tilt angle in step S207. Then, the process proceeds to step S208.

In step S208, the correcting unit 13 reflects, in a color registration formula, the amount of misalignment calculated in step S207.

On the other hand, when the Δposition is below the pattern detection threshold (No in step S206), the correcting unit 13 determines not to perform correction and completes the process without calculating the amount of misalignment.

Note that the process described above with reference to FIG. 14 may be executed upon the color registration control of correlating overlapping colors, for example. Alternatively, the process described above with reference to FIG. 14 may be executed once after the assembly in the manufacturing, to continue to use a value obtained in the process. Alternatively, the process described above with reference to FIG. 14 may be executed at another time, for example, upon the maintenance of the image forming devices 101C, 101K, 101Y, and 101M, to update the value.

In the present embodiment, the calculation in step S202 of FIG. 14 is implemented by software. Alternatively, the calculation in step S202 may be implemented by a circuit or circuitry (i.e., hardware). Such a case, in which a circuit or circuitry (i.e., hardware) implements the calculation in step S202, reduces the load of software while increasing circuit or circuitry cost. By contrast, when the calculation in step S202 of FIG. 14 is implemented by software, the load of software increases because of data acquisition in a relatively short cycle. Note that an increase in the load of software refers to an increase in the load of a CPU resulted from an increased usage rate. An increase in the circuit or circuitry cost refers to a cost increase simply caused by an increased number of parts for implementing the calculation in step S202 by hardware.

As described above, according to the present embodiment, the inappropriateness of the mounting angle of the sensor 203 with respect to the image forming face of the transfer belt 103 is detectable from the outputs of the sensor 203 corresponding to the specularly reflected light and the diffusely reflected light received. Accordingly, even at a low sampling rate, the misalignment of the color registration pattern 110 on the transfer belt 103 is reliably detectable, enhancing accurate registration of toner images.

Programs executed in the embodiments of the present disclosure are stored in e.g., the ROM 205 in advance, thus being providable. Alternatively, such programs may be stored in a computer-readable storage medium such as a compact disc read-only memory (CD-ROM), a flexible disk (FD), a compact disc recordable (CD-R), or a digital versatile or video disk (DVD), in a file in installable or executable format, thus being providable.

Alternatively, such programs may be stored in a computer connected to a network such as the Internet and downloaded via the network, thus being providable. Alternatively, such programs may be provided or distributed via a network such as the Internet.

The programs executed in the embodiments of the present disclosure has a module configuration including the functional units described above. As an actual hardware configuration, the CPU 204 reads the programs from the ROM 205 and executes the programs, thereby loading and generating the functional units described above on a main memory.

Note that in the embodiments described above, the image forming apparatus 1 is described as a tandem color copier. Alternatively, the image forming apparatus 1 may be, e.g., a printer, a scanner, a facsimile machine, or a multifunction peripheral (MFP) having at least two of copying, printing, scanning, facsimile, and plotter functions.

The embodiments of the present disclosure enhance accurate correction of misalignment of toner images even at a low sampling rate.

Although the present disclosure makes reference to specific embodiments, it is to be noted that the present disclosure is not limited to the details of the embodiments described above. Thus, various modifications and enhancements are possible in light of the above teachings, without departing from the scope of the present disclosure. It is therefore to be understood that the present disclosure may be practiced otherwise than as specifically described herein. For example, elements and/or features of different embodiments may be combined with each other and/or substituted for each other within the scope of the present disclosure. The number of constituent elements and their locations, shapes, and so forth are not limited to any of the structure for performing the methodology illustrated in the drawings.

Any one of the above-described operations may be performed in various other ways, for example, in an order different from that described above.

Any of the above-described devices or units can be implemented as a hardware apparatus, such as a special-purpose circuit or device, or as a hardware/software combination, such as a processor executing a software program.

Further, each of the functions of the described embodiments may be implemented by one or more processing circuits or circuitry. Processing circuitry includes a programmed processor, as a processor includes circuitry. A processing circuit also includes devices such as an application-specific integrated circuit (ASIC), digital signal processor (DSP), field programmable gate array (FPGA) and conventional circuit components arranged to perform the recited functions.

Further, as described above, any one of the above-described and other methods of the present disclosure may be embodied in the form of a computer program stored on any kind of storage medium. Examples of storage media include, but are not limited to, floppy disks, hard disks, optical discs, magneto-optical discs, magnetic tapes, nonvolatile memory cards, read only memories (ROMs), etc.

Alternatively, any one of the above-described and other methods of the present disclosure may be implemented by the ASIC, prepared by interconnecting an appropriate network of conventional component circuits or by a combination thereof with one or more conventional general-purpose microprocessors and/or signal processors programmed accordingly.

What is claimed is:

1. An image forming apparatus comprising:

an image bearer;

a driver configured to drive and rotate the image bearer;

an image forming device configured to form a toner image on the image bearer driven and rotated by the driver;

a sensor configured to emit light to the image bearer and receive reflected light; and processing circuitry configured to, control the driver and the image forming device to form a first toner image with a first color and a second toner image with a second color different from the first color, control the sensor to detect specularly reflected light and diffusely reflected light from the first toner image and the second toner image, determine a value of the specularly reflected light and a median value of the diffusely reflected light, and calculate an amount of misalignment of the first toner image and the second toner image based on the value of the specularly reflected light and the median value of the diffusely reflected light.

2. The image forming apparatus according to claim 1, wherein the processing circuitry is configured to calculate the amount of misalignment of the first toner image and the second toner image from a difference value between a peak value of the diffusely reflected light and the median value of the specularly reflected light.

3. The image forming apparatus according to claim 2, wherein the processing circuitry is configured to reflect the difference value in calculation of the amount of misalignment in response to the difference value exceeding a threshold.

4. The image forming apparatus according to claim 1, wherein the processing circuitry is configured to, subtract a component of the diffusely reflected light from a waveform of the specularly reflected light to obtain a subtraction waveform, and calculate the amount of misalignment of the first toner image and the second toner image from a difference value between a median value of the subtraction waveform and the median value of the specularly reflected light.

5. The image forming apparatus according to claim 4, wherein the processing circuitry is configured to reflect the difference value in calculation of the amount of misalignment in response to the difference value exceeding a threshold.

6. The image forming apparatus according to claim 1, wherein the processing circuitry is further configured to correct the misalignment of the first toner image and the second toner image based on the amount of misalignment calculated.

7. An image forming method comprising:

forming a first toner image with a first color and a second toner image with a second color different from the first color;

detecting specularly reflected light and diffusely reflected light from the first toner image and the second toner image;

determining a value of the specularly reflected light and a median value of the diffusely reflected light; and calculating an amount of misalignment of the first toner image and the second toner image based on the value of the specularly reflected light and the median value of the diffusely reflected light.

8. The image forming method according to claim 7, wherein the calculating calculates the amount of misalignment of the first toner image and the second toner image from a difference value between a peak value of the diffusely reflected light and the median value of the specularly reflected light.

9. The image forming method according to claim 7, further comprising:

subtracting a component of the diffusely reflected light from a waveform of the specularly reflected light to obtain a subtraction waveform, wherein the calculating calculates the amount of misalignment of the first toner image and the second toner image from a difference value between a median value of the subtraction waveform and the median value of the specularly reflected light.

10. A non-transitory, computer-readable storage medium storing computer-readable program code that causes a computer to perform an image forming method, the method comprising:

forming a first toner image with a first color and a second toner image with a second color different from the first color;

detecting specularly reflected light and diffusely reflected light from the first toner image and the second toner image;

determining a value of the specularly reflected light and a median value of the diffusely reflected light; and calculating an amount of misalignment of the first toner image and the second toner image based on the value of the specularly reflected light and the median value of the diffusely reflected light.

11. The non-transitory, computer-readable storage medium according to claim 10, wherein the computer-readable program code causes the computer to calculate the amount of misalignment of the first toner image and the second toner image from a difference value between a peak value of the diffusely reflected light and the median value of the specularly reflected light.

12. The non-transitory, computer-readable storage medium according to claim 10, wherein the computer-readable program code causes the computer to, subtract a component of the diffusely reflected light from a waveform of the specularly reflected light to obtain a subtraction waveform, and calculate the amount of misalignment of the first toner image and the second toner image from a difference value between a median value of the subtraction waveform and the median value of the specularly reflected light.

* * * * *